US011466499B2

(12) United States Patent
Elsmark

(10) Patent No.: US 11,466,499 B2
(45) Date of Patent: Oct. 11, 2022

(54) MANIPULATOR FOR AN ACCESS MEMBER, ACCESS MEMBER COMPRISING THE MANIPULATOR, SYSTEM AND METHOD

(71) Applicant: ASSA ABLOY AB, Stockholm (SE)

(72) Inventor: Lars Elsmark, Saltsjö-Boo (SE)

(73) Assignee: ASSA ABLOY AB, Stockholm (SE)

( * ) Notice: Subject to any disclaimer, the term of this patent is extended or adjusted under 35 U.S.C. 154(b) by 234 days.

(21) Appl. No.: 16/646,953

(22) PCT Filed: Sep. 4, 2018

(86) PCT No.: PCT/EP2018/073786
§ 371 (c)(1),
(2) Date: Mar. 12, 2020

(87) PCT Pub. No.: WO2019/057486
PCT Pub. Date: Mar. 28, 2019

(65) Prior Publication Data

US 2020/0208458 A1 Jul. 2, 2020

(30) Foreign Application Priority Data

Sep. 21, 2017 (SE) ..... 1751169-2

(51) Int. Cl.
*E05F 11/24* (2006.01)
*E05F 15/622* (2015.01)
(Continued)

(52) U.S. Cl.
CPC ..... *E05F 15/622* (2015.01); *E05F 15/63* (2015.01); *E05B 47/026* (2013.01);
(Continued)

(58) Field of Classification Search
CPC ..... E05B 53/00; E05B 47/062; E05B 2047/0051; E05B 2047/0023; E05D 3/18;
(Continued)

(56) References Cited

U.S. PATENT DOCUMENTS 1,920,868 A 6/1932 Kirk
2,582,666 A 1/1952 Young
(Continued)

FOREIGN PATENT DOCUMENTS

CN 2750013 1/2006
CN 101634512 1/2010
(Continued)

OTHER PUBLICATIONS

Official Action for Australia Patent Application No. 2018335042, dated Feb. 4, 2021, 5 pages.
(Continued)

*Primary Examiner* — Chi Q Nguyen
(74) *Attorney, Agent, or Firm* — Sheridan Ross P.C.

(57) ABSTRACT

A manipulator for controlling a locking function and a maneuvering function of an access member rotatably coupled to a frame is disclosed. The manipulator includes an actuator configured to provide a substantially linear first actuating movement in a first direction and a substantially linear second actuating movement in a second direction, opposite to the first direction; a latch bolt functionally coupled to the actuator, the latch bolt arranged to move to an unlocking position in response to movement of the actuator in the first direction and arranged to move to a locking position in response to movement of the actuator in the second direction; and a transmission mechanism functionally coupled to the actuator, the transmission mechanism configured to transmit the first actuating movement in the first direction provided by the actuator to an opening movement of the access member. An access member, a system and a method are also provided.

15 Claims, 4 Drawing Sheets

(51) Int. Cl.
*E05F 15/63* (2015.01)
*E05B 47/02* (2006.01)

(52) U.S. Cl.
CPC ..... *E05Y 2201/22* (2013.01); *E05Y 2201/434* (2013.01); *E05Y 2900/132* (2013.01)

(58) Field of Classification Search
CPC ..... E05D 3/186; E05F 15/63; E05F 15/622; E05Y 2201/22; E05Y 2201/42; E05Y 2600/46; E05Y 2800/10; E05Y 2900/132; E05Y 2600/62; E05Y 2201/434
USPC ..... 49/341, 324, 340, 339, 342, 343
See application file for complete search history.

(56) References Cited

U.S. PATENT DOCUMENTS 4,330,958 A * 5/1982 Richmond ..... E05B 47/026 49/280
4,679,451 A * 7/1987 Nakamura ..... F16H 25/20 74/606 R
4,796,385 A * 1/1989 Tyler ..... E05B 47/026 49/280
5,050,346 A 9/1991 Eccleston
5,804,938 A * 9/1998 Richmond ..... G05B 19/23 318/282
5,869,940 A * 2/1999 Parsadayan ..... E05F 15/622 318/461
5,910,692 A * 6/1999 Saeda ..... F16H 25/20 310/13
5,911,460 A * 6/1999 Hawkins ..... E05B 63/248 292/254
6,256,928 B1 * 7/2001 Skeem ..... E05F 15/622 49/340
6,935,000 B1 * 8/2005 Arnaud ..... E05F 1/068 16/239
7,032,937 B2 * 4/2006 Boecker ..... E05B 81/14 292/201
7,445,258 B2 * 11/2008 Rice ..... E05B 81/22 292/341.16
8,578,656 B2 * 11/2013 Yates ..... E06B 11/02 49/465
8,667,736 B2 * 3/2014 Sullivan ..... E01F 13/06 49/49
8,844,200 B2 9/2014 Yulkowski
2005/0091928 A1 5/2005 Okulov et al.
2006/0090400 A1 5/2006 Los et al.
2006/0284428 A1 12/2006 Beadle et al.
2007/0268132 A1 11/2007 Milo
2008/0061561 A1 3/2008 Uryasov
2008/0236045 A1 10/2008 DeBlonk
2010/0018122 A1 1/2010 Hecht et al.
2014/0090205 A1 4/2014 Sarnowski
2015/0259960 A1 9/2015 Smith
2017/0226778 A1 8/2017 McKibben et al.
2018/0016836 A1 1/2018 Ibsies

FOREIGN PATENT DOCUMENTS

EP 0937852 8/1999
EP 1061225 12/2000
EP 2607593 6/2013
FR 2312634 12/1976
GB 2358221 7/2001
GB 2486815 6/2012
JP 2013-064246 4/2013

OTHER PUBLICATIONS

Official Action with English Translation for China Patent Application No. 201880060313.2, dated Jan. 15, 2021, 20 pages.
Official Action for Australia Patent Application No. 2018335042, dated Mar. 16, 2021, 3 pages.
International Search Report and Written Opinion for International (PCT) Patent Application No. PCT/EP2018/073786, dated Nov. 22, 2018, 11 pages.
International Preliminary Report on Patentability for International (PCT) Patent Application No. PCT/EP2018/073786, dated Jan. 17, 2020, 25 pages.
Search Report for Sweden Patent Application No. 1751169-2, dated Apr. 17, 2018, 3 pages.
Official Action for Sweden Patent Application No. 1751169-2, dated Apr. 17, 2018, 5 pages.
Official Action for Australia Patent Application No. 2018335042, dated Jul. 30, 2021, 4 pages.
Official Action with English Translation for China Patent Application No. 201880060313.2, dated Jun. 10, 2021, 7 pages.
Official Action with English Translation for China Patent Application No. 201880060313.2, dated Aug. 20, 2021, 10 pages.
Official Action with English Translation for China Patent Application No. 201880060313.2, dated Jan. 11, 2022, 9 pages.

* cited by examiner

MANIPULATOR FOR AN ACCESS MEMBER, ACCESS MEMBER COMPRISING THE MANIPULATOR, SYSTEM AND METHOD

CROSS REFERENCE TO RELATED APPLICATIONS

This application is a national stage application under 35 U.S.C. 371 and claims the benefit of PCT Application No, PCT/EP2018/073786 having an international filing date of 4 Sep. 2018, which designated the United States, which PCT application claimed the benefit of Sweden Patent Application No. 1751169-2 filed 21 Sep. 2017, the disclosure of each of which are incorporated herein by reference.

TECHNICAL FIELD

The present disclosure generally relates to a manipulator for controlling a locking function and a maneuvering function of an access member rotatably coupled to a frame. In particular, a manipulator for controlling a locking function and a maneuvering function of an access member rotatably coupled to a frame, the manipulator comprising a latch bolt, an actuator and a transmission mechanism; an access member comprising the manipulator; a system comprising a frame, an access member and the manipulator and a method for controlling a locking function and a maneuvering function of an access member are provided.

BACKGROUND

Various types of manipulators for operating doors are known. US 2005091928 A1 discloses an automatic door opener attached to an upper portion of a door frame and comprising an arm pivotally connected to its housing and having a roller at its free end. When swung, the arm pushes the door through a pilot plate. When the arm is retracted, the door is closed either by the action of the door closer or by the arm.

The door opener in US 2005091928 A1 has a bulky and complicated structure that, for example, is easy to break.

SUMMARY

One object of the present disclosure is to provide a manipulator for controlling both a locking function and a maneuvering function of an access member.

A further object of the present disclosure is to provide a compact manipulator for controlling a locking function and a maneuvering function of an access member that can be integrated into the access member, i.e. concealed.

A still further object of the present disclosure is to provide a manipulator for controlling a locking function and a maneuvering function of an access member that has a simple, cheap and/or reliable design.

A still further object of the present disclosure is to provide a manipulator for controlling a locking function and a maneuvering function of an access member that has a good strength to survive abuse.

A still further object of the present disclosure is to provide a manipulator for controlling a locking function and a maneuvering function of an access member that has a high opening force and/or a high closing force to the access member.

According to one aspect, there is provided a manipulator for controlling a locking function and a maneuvering function of an access member rotatably coupled to a frame, the manipulator comprising an actuator configured to provide a substantially linear first actuating movement in a first direction and a substantially linear second actuating movement in a second direction, opposite to the first direction; a latch bolt functionally coupled to the actuator, the latch bolt arranged to move to an unlocking position in response to movement of the actuator in the first direction and arranged to move to a locking position in response to movement of the actuator in the second direction; and a transmission mechanism functionally coupled to the actuator, the transmission mechanism configured to transmit the first actuating movement in the first direction provided by the actuator to an opening movement of the access member.

Throughout the present disclosure, the functional coupling between the latch bolt and the actuator may for example be constituted by a mechanical coupling, an electrical coupling, or an electromechanical coupling. In case the functional coupling is constituted by a mechanical coupling, the latch bolt may be directly coupled to the actuator, or indirectly coupled to the actuator, e.g. by means of one or several intermediate components.

Throughout the present disclosure, the functional coupling between the transmission mechanism and the actuator may for example be constituted by a mechanical coupling, an electrical coupling, or an electromechanical coupling. In case the functional coupling is constituted by a mechanical coupling, the transmission mechanism may be directly coupled to the actuator, or indirectly coupled to the actuator, e.g. by means of one or several intermediate components.

The manipulator according to the present disclosure may alternatively be referred to as a dual function access member manipulator or a dual function door manipulator, when used to manipulate a door. The access member may for example be constituted by a door or a door leaf. The access member may be rigid and have a flat appearance.

The manipulator may be configured such that when the actuator moves a first distance in the first direction, the latch bolt is moved from the locking position to the unlocking position by means of the first actuating movement and when the actuator moves a second distance, beyond the first distance, in the first direction, the transmission mechanism transmits the first actuating movement in the first direction provided by the actuator to an opening movement of the access member.

The access member may be coupled to the frame by means of at least one hinge, such as a barrel hinge or a concealed hinge. The frame may be constituted by an opening in a wall. Alternatively, the frame may be constituted by a structure attachable to an opening in a wall.

A substantially linear actuating movement may include movements where a tangent of the momentary movement is angled up to 5°, such as up to 2°, with respect to a perfectly linear actuating movement. However, the actuator according to the present disclosure may also be configured to provide a linear first actuating movement in the first direction and/or a linear second actuating movement in the second direction.

The actuator may be configured to provide the substantially linear first actuating movement in the first direction and the substantially linear second actuating movement in the second direction substantially perpendicular to an interface plane between the access member and the frame when the access member is in a closed position. The interface plane may alternatively be referred to as a mating plane and may be constituted by a plane parallel with the vertical (hinge) side surface of a conventional door and the mating surface of the frame when the door is closed. Thus, the substantially linear actuating movement may be carried out in a main extension plane of the access member. The first direction and the second direction may be substantially horizontal.

The actuator may be of various types. For example, the actuator may be constituted by a mechanical actuator such as a screw actuator, a hydraulic actuator, a pneumatic actuator, an electro-mechanical actuator, a linear motor etc. The actuator may be electrically powered in any suitable manner.

According to one variant, the actuator comprises a rotatable lead screw. The actuator may further comprise an electric motor arranged to rotate the lead screw.

The actuator may comprise a driven latch member rigidly connected to, or integrally formed with, the latch bolt and the driven latch member may be engaged with the lead screw. The lead screw may comprise an external thread and the driven latch member may comprise an internal thread threadingly engaging the external thread of the lead screw. The driven latch member may have a generally cylindrical appearance. The internal thread may be provided on an inwardly protruding collar of the driven latch member.

The transmission mechanism according to the present disclosure may adopt a wide range of different designs. In many realizations, the transmission mechanism comprises or is constituted by a linkage.

The transmission mechanism may comprise a rod arranged to move in the first direction in response to movement of the actuator in the first direction and arranged to move in the second direction in response to movement of the actuator in the second direction. According to one variant, the transmission mechanism is constituted by, i.e. comprises only, the rod.

The actuator may further comprise a driven rod member coupled to the rod. The driven rod member may have a generally cylindrical appearance and may comprise an internal thread threadingly engaging the external thread of the lead screw. The internal thread may be provided on an inwardly protruding collar of the driven rod member.

The transmission mechanism may further comprise an elastic element. The elastic element may be arranged between the rod and the actuator, e.g. between the rod and the driven rod member. Alternatively, the rod may be arranged between the actuator and the elastic element. The elastic element may for example be constituted by a spring, such as a compression spring, a piston damper (for example a pneumatic piston damper or a spring based piston damper), a rubber component or even magnets exhibiting elastic properties due to a repelling action.

The transmission mechanism may further comprise a hinge mechanism configured to transmit a movement of the rod in the first direction to an opening movement of the access member. The hinge mechanism may be configured to be connected between surfaces of the access member and the frame facing each other when the access member is in a closed position. These surfaces may be constituted by a vertical (hinge) side surface of a conventional door and the mating surface of the frame when the door is closed.

The hinge mechanism may additionally be configured to transmit a movement of the rod in the second direction to a closing movement of the access member. In this case, the rod may be coupled, directly or indirectly, to the hinge mechanism. Alternatively, the hinge mechanism may only be configured to transmit a movement of the rod in the first direction to an opening movement of the access member. In this case, the closing movement of the access member may be assisted by means of a spring mechanism.

The opening movement and the closing movement of the access member constitute maneuvering functions of the access member. The locking movement and the unlocking movement of the latch bolt constitute locking functions of the access member.

The hinge mechanism may comprise a first arm and a second arm rotatably connected to the first arm according to the present disclosure. The first arm may be configured to be rotatably connected to the frame and the second arm may be configured to be rotatably connected to the access member. The second arm may be configured to be guided in a slot in the frame. The first arm may be pushed by the rod when moving in the first direction to provide an opening movement of the access member. The first arm and the second arm of the hinge mechanism may each have a general L-shaped appearance.

The hinge mechanism may alternatively be constituted by a concealed hinge. A central link of the concealed hinge may be used to transfer movements of the rod in the first direction to an opening movement of the access member. For example, the rod may be coupled to the central link of the concealed hinge. In this case, the central link of the concealed hinge may also be used to transfer movements of the rod in the second direction to a closing movement of the access member.

The manipulator may further comprise a tube in which components of the manipulator are arranged. The tube may be inserted into a bore through the access member, e.g. a horizontal bore parallel with the main extension plane of the access member. The tube may for example be made of metal.

In case the actuator comprises a lead screw and an electric motor, the lead screw may be arranged in the tube and the electric motor may be arranged either inside the tube or outside the tube. The electric motor may for example be arranged inside the access member, but distanced from the tube, and the lead screw may be driven by the electric motor via any type of transmission, such as a gear. As a further example, the electric motor may be arranged outside the access member, such as in the frame and the lead screw may be driven by the electric motor via any type of transmission.

The transmission mechanism may be configured to transmit the second actuating movement in the second direction provided by the actuator to a closing movement of the access member. Throughout the present disclosure, the opening movement and the closing movement may be a rotational opening movement and a rotational closing movement, respectively, of the access member.

The transmission mechanism may alternatively be configured to transmit only the first actuating movement in the first direction provided by the actuator to an opening movement of the access member. The transmission mechanism may serve as an "initiator" to merely initiate an opening movement of the access member.

According to a further aspect, there is provided an access member comprising a manipulator according to the present disclosure, wherein the manipulator is arranged inside the access member. The actuator may be configured to provide the substantially linear first actuating movement in the first direction and the substantially linear second actuating movement in the second direction in a substantially vertical plane comprised by the access member and parallel with a main surface of the access member when the access member is substantially vertically oriented in the closed position. Correspondingly, the actuator may be configured to provide the substantially linear first actuating movement in the first direction and the substantially linear second actuating movement in the second direction in a substantially horizontal plane comprised by the access member and parallel with a main surface of the access member when the access member is substantially horizontally oriented in the closed position. In this manner, the actuator may be fully integrated in the access member and may thereby be hidden when the access member is in the closed position.

Throughout the present disclosure, the terminology substantially vertical, substantially horizontal, substantially parallel etc. is intended to embrace variants having deviations of up to 5°, such as up to 2°, with respect to an ideal orientation. Of course this terminology also embraces vertical, horizontal, parallel etc. (i.e. without the preceding "substantially").

According to a further aspect, there is provided a system comprising a frame, an access member rotatably coupled to the frame and a manipulator according to the present disclosure, wherein the manipulator is arranged inside the access member. Throughout the present disclosure, the system may alternatively be referred to as a door assembly.

The system may further comprise at least one hinge. The at least one hinge may be of any suitable type to rotationally couple the access member to the frame and rotationally support the access member between a closed position and an open position. The hinge may for example be constituted by a barrel hinge substantially as shown in US 2014090205 A1. Alternatively, or in addition, the hinge may be constituted by a concealed hinge substantially as shown in US 2015259960 A1.

With a barrel hinge, the access member may rotate with respect to the frame about a single hinge axis. In this case, the transmission mechanism may be configured to transmit the actuating movement in the first direction provided by the actuator to a rotational opening movement of the access member.

With a concealed hinge, the access member may "move out" a bit during rotation to enable, for example, a 180° rotation with respect to the frame. However, also in this case, the transmission mechanism is considered to be configured to transmit the actuating movement in the first direction provided by the actuator to a rotational opening movement of the access member.

A closed position may be constituted by a position where the access member is substantially flush with, or substantially parallel with, the frame. An open position may be constituted by a position where the access member is angled with respect to the frame. In the open position, an angle between the access member and the frame may be, for example, 10°, 20°, 30°, 45°, 60°, 75°, 90°, 135°, 180°, or more than 180°.

In case the frame is vertically oriented, the at least one hinge may be provided on a vertical side or a horizontal top side or bottom side of the access member. Corresponding configurations may also be employed when the frame is horizontally oriented or inclined. The system may further comprise a spring mechanism used to close, or assist to close, the access member, i.e. to provide a closing movement force to the access member.

The transmission mechanism of the manipulator of the system may comprise a hinge mechanism. The hinge mechanism may comprise a first arm and a second arm rotatably connected to the first arm according to the present disclosure. The first arm may be rotatably connected to the frame and the second arm may be rotatably connected to the access member. The second arm may be guided in a slot in the frame.

Alternatively, the hinge mechanism may be constituted by a concealed hinge. In this case, a central link of the concealed hinge may be used to transfer movements of the rod in the first direction to an opening movement of the access member.

According to a further aspect, there is provided a method of controlling a locking function and a maneuvering function of an access member rotatably coupled to a frame, the method comprising driving an actuator to provide a substantially linear first actuating movement in a first direction such that a latch bolt, functionally coupled to the actuator, moves from a locking position to an unlocking position; and transmitting the first actuating movement in the first direction provided by the actuator to an opening movement of the access member. The step of transmitting the first actuating movement in the first direction provided by the actuator to an opening movement of the access member may be carried out after the step of moving the latch bolt from the locking position to the unlocking position.

The method may further comprise driving the actuator to provide a substantially linear second actuating movement in a second direction, opposite to the first direction, such that the latch bolt moves from the unlocking position to the locking position.

The method may further comprise driving the actuator to provide a substantially linear second actuating movement in a second direction; and transmitting the second actuating movement in the second direction provided by the actuator to a closing movement of the access member. In this case, the step of transmitting the second actuating movement in the second direction provided by the actuator to a closing movement of the access member may be carried out before the step of moving the latch bolt from the unlocking position to the locking position.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated.

BRIEF DESCRIPTION OF THE DRAWINGS

The invention is now described, by way of example, with reference to the accompanying drawings, in which.

DETAILED DESCRIPTION

The invention will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Like numbers refer to like elements throughout the description.

Figure 1:
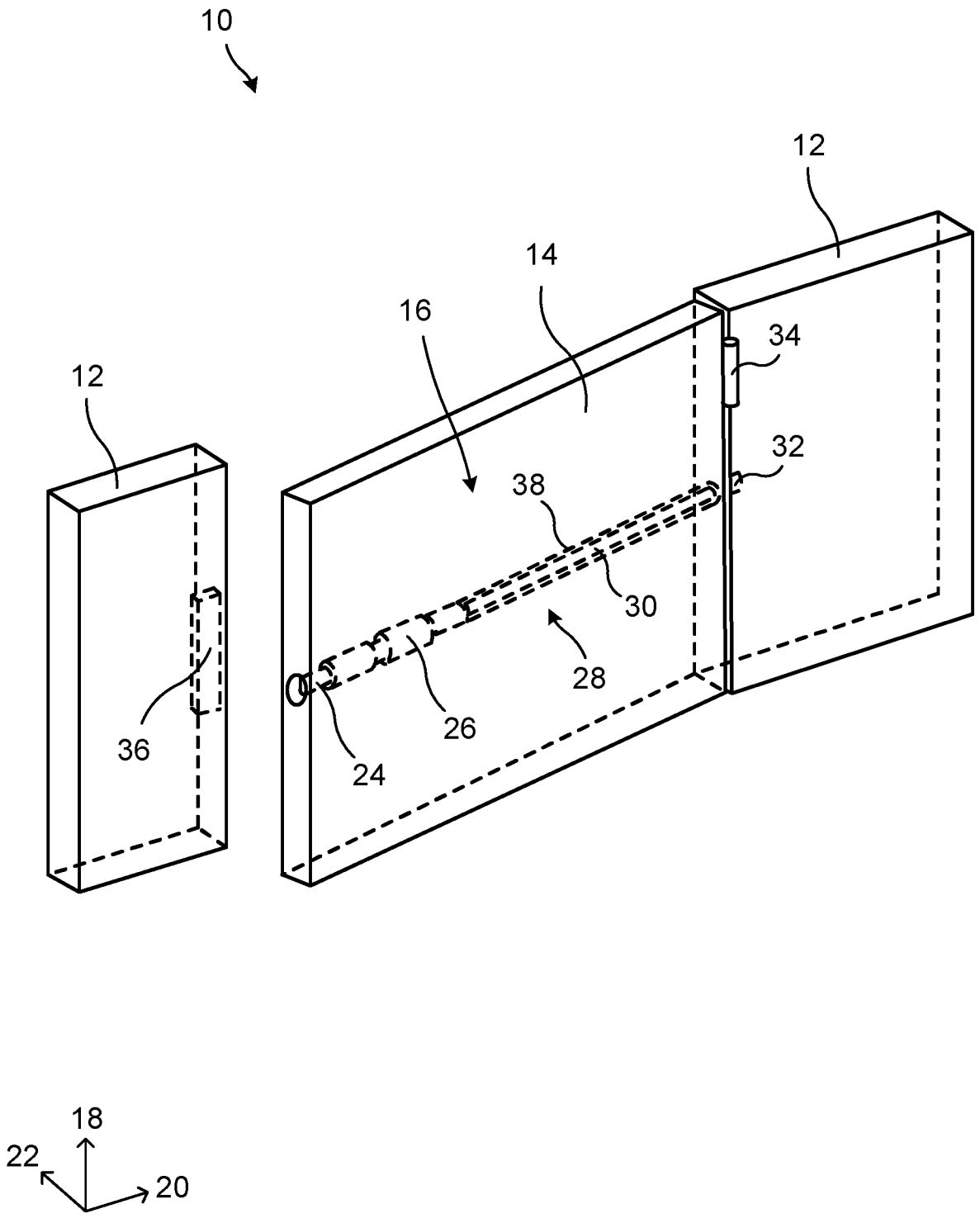
FIG. 1: schematically represents a perspective view of a system comprising a frame, an access member and a manipulator.

FIG. 1 schematically represents a perspective view of a system 10 comprising a frame 12, an access member 14 and a manipulator 16. In FIG. 1, the access member 14, exemplified as a door, is in an open position. FIG. 1 further illustrates a vertical direction 18, a first horizontal direction 20 and a second horizontal direction 22, perpendicular to the first horizontal direction 20.

The manipulator 16 comprises a latch bolt 24, an actuator 26 and a transmission mechanism 28. The transmission mechanism 28 comprises a rod 30 and a hinge mechanism 32. The transmission mechanism 28 thereby constitutes a linkage. The access member 14 is rotatably coupled to the frame 12 by a barrel hinge 34 and by the hinge mechanism 32. A strike plate 36 is provided in the frame 12 for being engaged by the latch bolt 24 to lock the access member 14 in a closed position.

The manipulator 16 further comprises a tube 38. In this example, the components of the manipulator 16, i.e. the latch bolt 24, the actuator 26 and the transmission mechanism 28 are arranged within the tube 38. The hinge mechanism 32 of the transmission mechanism 28 is partly arranged within the tube 38. The tube 38 is inserted in a horizontal bore through the access member 14.

Figure 2:
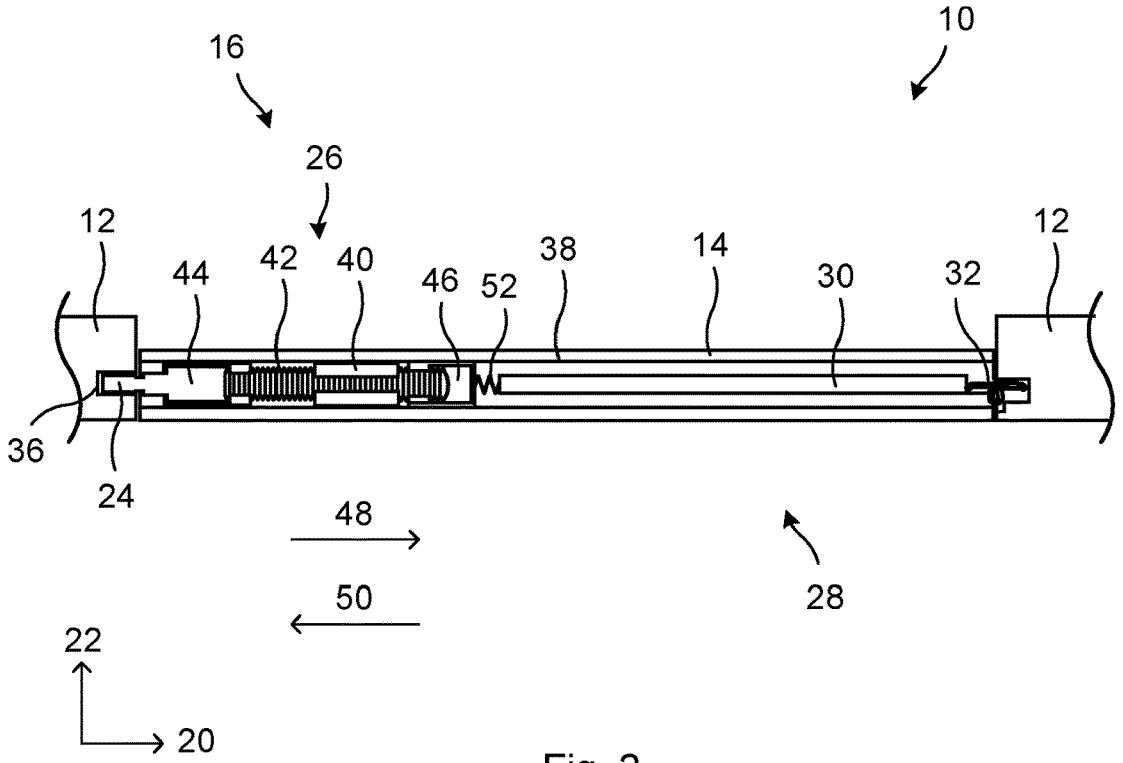
FIG. 2: schematically represents a partial top view of the system.

FIG. 2 schematically represents a partial top view of the system 10. In FIG. 2, the access member 14 is in a closed position. The latch bolt 24 has adopted a locking position where the latch bolt 24 is received in the strike plate 36 of the frame 12. The access member 14 is thereby also in a locked position.

Figure 3:
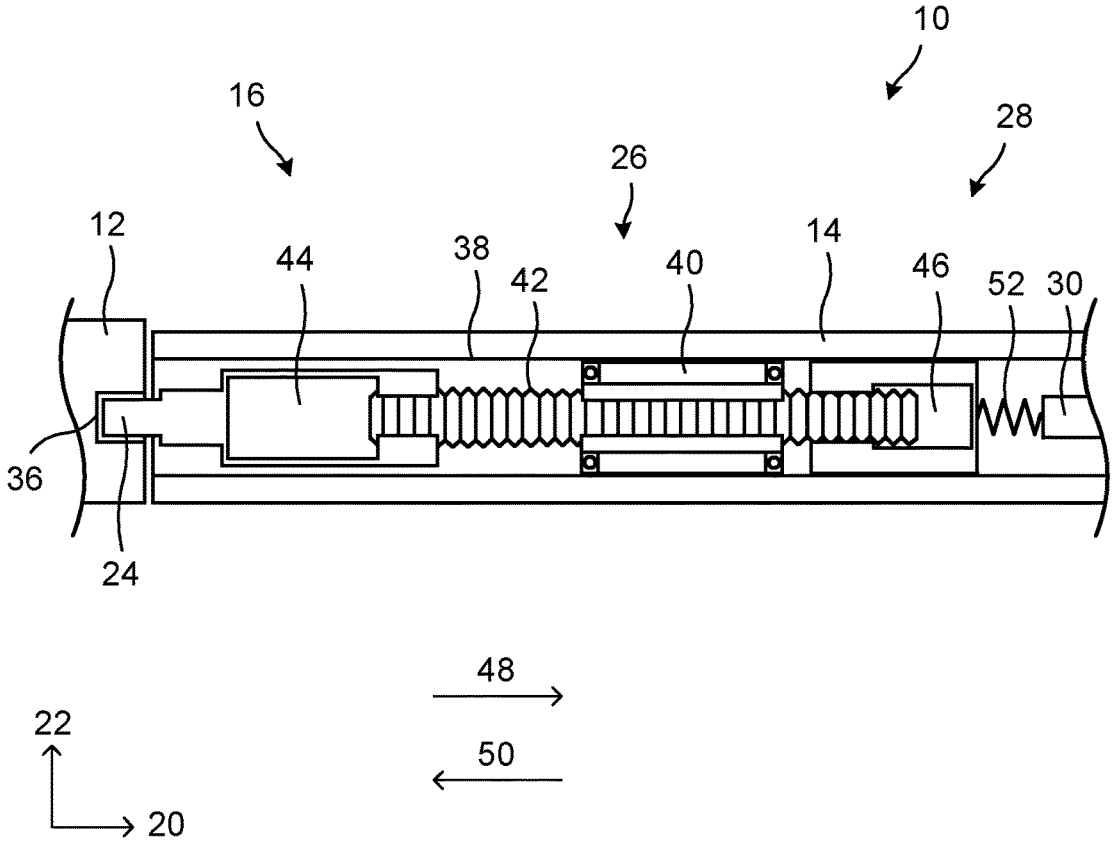
FIG. 3: schematically represents a top view of an actuator of the manipulator of the system.

FIG. 3 schematically represents a top view of the actuator 26 of the manipulator 16 of the system 10. With collective reference to the example in FIGS. 2 and 3, the actuator 26 of the manipulator 16 comprises an electric motor 40 and a lead screw 42. By means of the electric motor 40, the lead screw 42 can be rotated either clockwise or counterclockwise about its extension axis. The electric motor 40 may alternatively be arranged outside the tube 38 and drive the lead screw 42 via a suitable transmission, such as a gear.

The actuator 26 further comprises a driven latch member 44 and a driven rod member 46. Each of the driven latch member 44 and the driven rod member 46 has a generally cylindrical appearance and is engaged with the lead screw 42. As can be seen in FIG. 3, the external thread of the lead screw 42 is threadingly engaged by internal threads of the driven latch member 44 and the driven rod member 46. Thus, by rotating the lead screw 42 in one direction (e.g. clockwise), the driven latch member 44 and the driven rod member 46 are moved in a first direction 48. By rotating the lead screw 42 in another direction (e.g. counterclockwise), the driven latch member 44 and the driven rod member 46 are moved in a second direction 50, opposite to the first direction 48.

The driven latch member 44 and the driven rod member 46 are each guided linearly within the tube 38 and are prevented from rotating. In FIGS. 2 and 3, the first direction 48 and the second direction 50 are parallel with the first horizontal direction 20 and are perpendicular to an interface plane between the access member 14 and the frame 12.

The movement of the driven latch member 44 and the driven rod member 46 in the first direction 48 is referred to as a first actuating movement by the actuator 26 and the movement of the driven latch member 44 and the driven rod member 46 in the second direction 50 is referred to as a second actuating movement by the actuator 26.

In the example of FIGS. 2 and 3, the latch bolt 24 is integrally formed with the driven latch member 44. Thus, the latch bolt 24 is arranged to move to an unlocking position in response to movement of the actuator 26 in the first direction 48 and arranged to move to the illustrated locking position in response to movement of the actuator 26 in the second direction 50.

The manipulator 16 further comprises an elastic element 52. In FIGS. 2 and 3, the elastic element 52 is exemplified as a compression spring arranged between the driven rod member 46 and the rod 30. Due to the first actuating movement in the first direction 48 provided by the actuator 26, the elastic element 52 is initially compressed. When the first actuating movement continues, also the rod 30 starts to move in the first direction 48 within the tube 38. The rod 30 pushes on the hinge mechanism 32 such that the hinge mechanism 32 starts to open. In this way, the transmission mechanism 28 is functionally coupled to the actuator 26 and configured to transmit the first actuating movement in the first direction 48 provided by the actuator 26 to an opening movement of the access member 14.

Due to the second actuating movement in the second direction 50 provided by the actuator 26, the elastic element 52 is initially expanded. When the second actuating movement continues, also the rod 30 starts to move in the second direction 50 within the tube 38. The movement of the rod 30 in the second direction 50 may or may not generate a closing movement of the access member 14. If not, the closing movement of the access member 14 may be generated by means of a spring mechanism (not illustrated) outside the manipulator 16, e.g. adjacent to the barrel hinge 34.

The transmission mechanism 28 may alternatively comprise only the rod 30, i.e. not comprise the elastic element 52 or the hinge mechanism 32. In this case, the rod 30 can push directly on the frame 12 to provide an opening movement of the access member 14.

Alternatively, the transmission mechanism 28 may comprise only the rod 30 and the elastic element 52, i.e. not comprise the hinge mechanism 32. In this case, the rod 30 can push directly, or via the elastic element 52, on the frame 12 to provide an opening movement of the access member 14.

Alternatively, the transmission mechanism 28 may comprise only the rod 30 and the hinge mechanism 32, i.e. not comprise the elastic element 52. In this case, the rod 30 may immediately push on the hinge mechanism 32 when the first actuating movement in the first direction 48 provided by the actuator 26 is initiated.

Figure 4A:
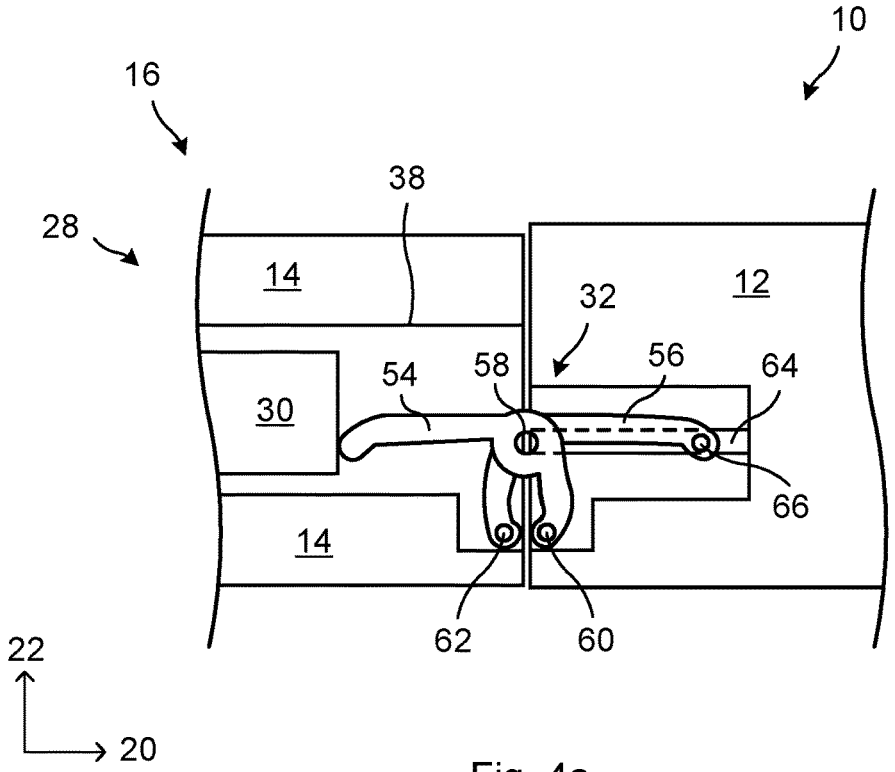
FIG. 4*a*: schematically represents a top view of a hinge mechanism of the manipulator of the system.
Figure 4B:
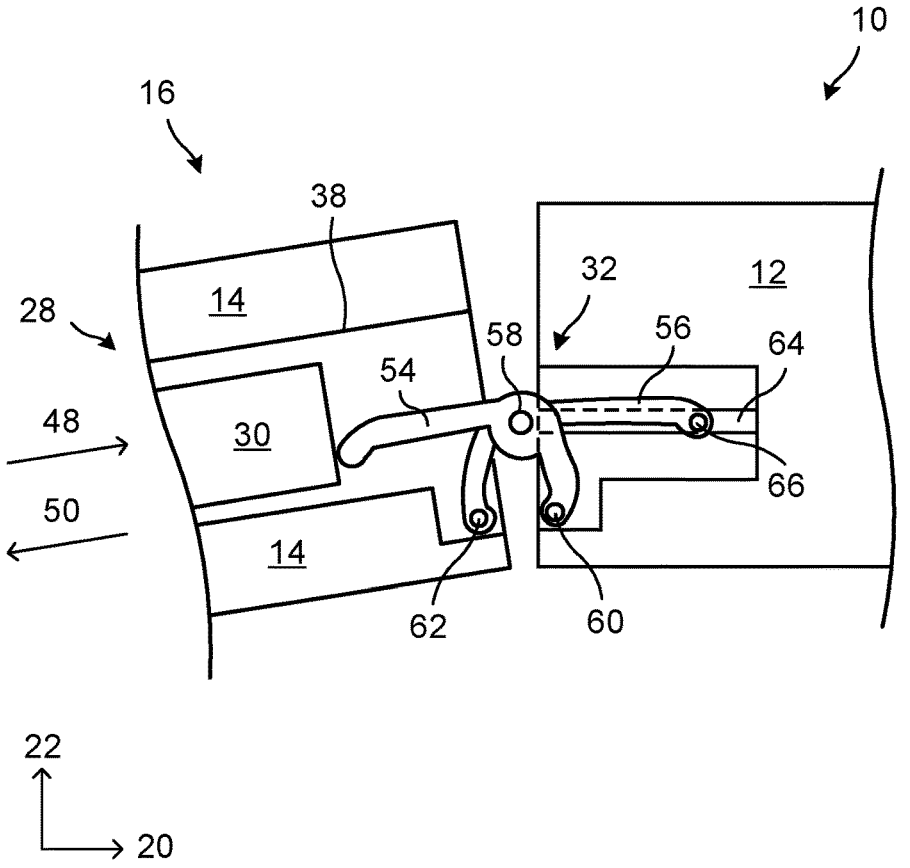
FIG. 4*b*: schematically represents a top view of the hinge mechanism.

FIGS. 4*a* and 4*b* schematically represent a top views of the hinge mechanism 32 of the manipulator 16 in a closed position and an open position, respectively. With collective reference to FIGS. 4*a* and 4*b*, the hinge mechanism 32 comprises a first arm 54 and a second arm 56. The first arm 54 and the second arm 56 are rigid and each has a general L-shaped appearance. The first arm 54 is rotatably connected to the second arm 56 by means of a pin joint 58. The first arm 54 is rotatably connected to the frame 12 at a first pivot 60 and the second arm 56 is rotatably connected to the access member 14 at a second pivot 62. A horizontal slot 64 is provided in the frame 12. The second arm 56 comprises a pin 66 engaged in the slot 64 such that the pin 66 can travel along the slot 64.

In FIG. 4*a*, the access member 14 is in the closed position and the rod 30 abuts the end of the first arm 54 of the hinge mechanism 32. When the rod 30 moves in the first direction 48, due to the actuating movement in the first direction 48 provided by the actuator 26, the rod 30 pushes the first arm 54 of the hinge mechanism 32. As a consequence, the hinge mechanism 32 moves from the closed position to the open position illustrated in FIG. 4*b*. The hinge mechanism 32 is thereby configured to transmit a movement of the rod 30 in the first direction 48 to an opening movement of the access member 14.

As can be seen in FIG. 4*b*, the pin 66 of the second arm 56 has travelled along the slot 64 (to the left in FIG. 4*b*) and the pin joint 58 has also been displaced. Both the first arm 54 and the second arm 56 have also been slightly rotated counterclockwise.

Figure 5:
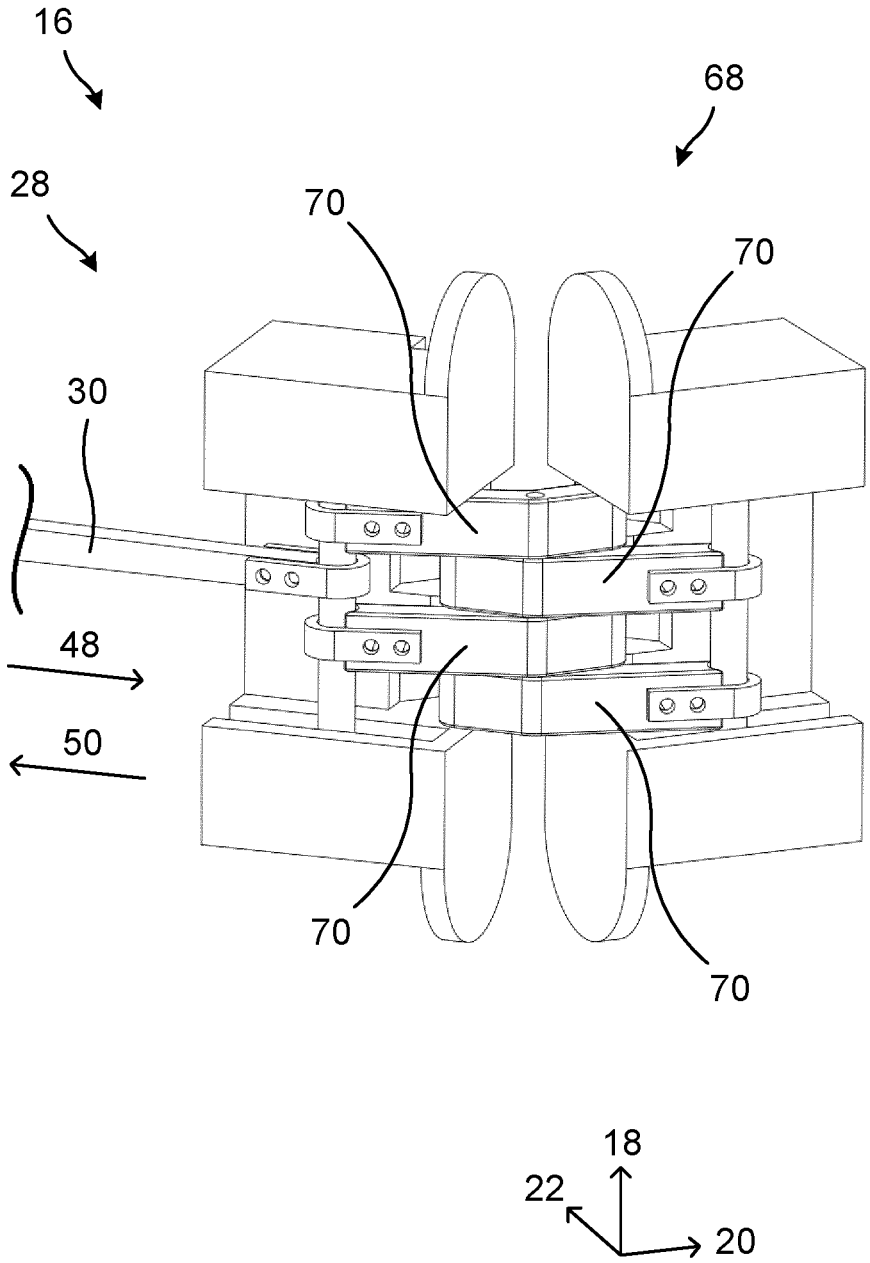
FIG. 5: schematically represents a perspective view of an alternative hinge mechanism.

FIG. 5 schematically represents a perspective view of an alternative hinge mechanism 68. The hinge mechanism 68 may replace the hinge mechanism 32 in the manipulator 16 according to FIGS. 1 to 4. The hinge mechanism 68 in FIG. 5 is constituted by a concealed hinge. The hinge mechanism 68 is configured to be connected between surfaces of the access member 14 and the frame 12 facing each other when the access member 14 is in the closed position.

The hinge mechanism 68 of the example in FIG. 5 comprises four central links 70. As illustrated in FIG. 5, the rod 30 is coupled to one of the central links 70. The central link 70 of the hinge mechanism 68 is thereby configured to transfer movements of the rod in the first direction 48 to an opening movement of the access member 14. In this case, the central link 70 is pushed by the rod 30. The central link 70 of the hinge mechanism 68 is also configured to transfer movements of the rod 30 in the second direction 50 to a closing movement of the access member 14. In this case, the central link 70 is pulled by the rod 30.

While the present disclosure has been described with reference to exemplary embodiments, it will be appreciated that the present invention is not limited to what has been described above. For example, it will be appreciated that the dimensions of the parts may be varied as needed. Accordingly, it is intended that the present invention may be limited only by the scope of the claims appended hereto.

What is claimed is:

1. Manipulator for controlling a locking function and a maneuvering function of an access member rotatably coupled to a frame, the manipulator comprising:

an actuator configured to provide a substantially linear first actuating movement in a first direction and a substantially linear second actuating movement in a second direction, opposite to the first direction;

a latch bolt functionally coupled to the actuator, the latch bolt arranged to move to an unlocking position in response to the first actuating movement of the actuator in the first direction and arranged to move to a locking position in response to the second actuating movement of the actuator in the second direction; and a transmission mechanism functionally coupled to the actuator, the transmission mechanism configured to transmit the first actuating movement in the first direction provided by the actuator to an opening movement of the access member.

2. The manipulator according to claim 1, wherein the first direction and the second direction are substantially horizontal.

3. The manipulator according to claim 1, wherein the actuator comprises a rotatable lead screw.

4. The manipulator according to claim 3, wherein the actuator comprises an electric motor arranged to rotate the lead screw.

5. The manipulator according to claim 3, wherein the actuator comprises a driven latch member rigidly connected to, or integrally formed with, the latch bolt and wherein the driven latch member is engaged with the lead screw.

6. The manipulator according to claim 1, wherein the transmission mechanism comprises a rod arranged to move in the first direction in response to movement of the actuator in the first direction and arranged to move in the second direction in response to movement of the actuator in the second direction.

7. The manipulator according to claim 6, wherein the transmission mechanism further comprises an elastic element.

8. The manipulator according to claim 6, wherein the transmission mechanism further comprises a hinge mechanism configured to transmit a movement of the rod in the first direction to an opening movement of the access member.

9. The manipulator according to claim 1, further comprising a tube that houses components of the manipulator.

10. The manipulator according to claim 1, wherein the transmission mechanism is configured to transmit the second actuating movement in the second direction provided by the actuator to a closing movement of the access member.

11. Access member comprising a manipulator according to claim 1, wherein the manipulator is arranged inside the access member.

12. System comprising a frame, an access member rotatably coupled to the frame, and a manipulator according to claim 1, wherein the manipulator is arranged inside the access member.

13. The system according to claim 12, wherein the hinge mechanism comprises a first arm and a second arm rotatably connected to the first arm, wherein the first arm is rotatably connected to the frame and the second arm is rotatably connected to the access member and wherein the second arm is guided in a slot in the frame.

14. Method of controlling a locking function and a maneuvering function of an access member rotatably coupled to a frame, the method comprising:

providing a manipulator;

driving an actuator of the manipulator to provide a substantially linear first actuating movement in a first direction such that latch bolt moves from a locking position to an unlocking position;

transmitting, with a transmission mechanism, the first actuating movement in the first direction provided by the actuator to an opening movement of the access member; and driving the actuator to provide a substantially linear second actuating movement in a second direction, opposite to the first direction, such that the latch bolt moves from the unlocking position to the locking position.

15. The method according to claim 14, further comprising:

driving the actuator to provide the substantially linear second actuating movement in the second direction; and transmitting the second actuating movement in the second direction provided by the actuator to a closing movement of the access member by means of the transmission mechanism.

* * * * *